United States Patent [19]

Small

[11] 4,127,165

[45] Nov. 28, 1978

[54] ANGULAR ROD BAFFLE

[75] Inventor: William M. Small, Bartlesville, Okla.

[73] Assignee: Phillips Petroleum Company, Bartlesville, Okla.

[21] Appl. No.: 703,028

[22] Filed: Jul. 6, 1976

[51] Int. Cl.[2] ..... F28F 9/00

[52] U.S. Cl. ..... 165/162; 122/510; 248/49

[58] Field of Search ..... 165/159, 161, 113, 114, 165/162

[56] References Cited

U.S. PATENT DOCUMENTS

| | | | |
|---|---|---|---|
| 1,882,474 | 10/1932 | Black | 165/162 |
| 2,018,037 | 10/1935 | Sieder | 165/162 X |
| 2,384,714 | 9/1945 | Villiger | 165/161 |
| 3,438,434 | 4/1969 | Smith | 165/162 X |
| 3,708,142 | 1/1973 | Small | 165/162 |
| 3,967,677 | 7/1976 | Mohlman | 165/162 |

*Primary Examiner*—Charles J. Myhre
*Assistant Examiner*—Theophil W. Streule, Jr.

[57] ABSTRACT

A baffle comprises an outer ring suitable for surrounding a plurality of parallel tubes formed into a tube bundle, said tube bundle having at least a first plurality of parallel tube rows, a second plurality of parallel tube rows, and spaces between the adjacent tube rows, said outer ring positioned in a plane which is not perpendicular to the longitudinal axis of the tube bundle, said plane forming a baffle angle with a plane which is perpendicular to the longitudinal axis of the tube bundle, and a plurality of parallel rods cooperating with and attached to the outer ring to form a plurality of parallel chords with the outer ring wherein the rods are capable of passing in the spaces between the tubes forming adjacent parallel tube rows of one plurality of parallel tube rows.

20 Claims, 11 Drawing Figures

U IS THE OVERALL HEAT TRANSFER COEFICIENT.
TO CONVERT U IN $\frac{BTU}{(HR)(FT^2)(^oF)}$ TO $\frac{WATTS}{(M^2)(^oK)}$
MULTIPLY BY 5.678
TO CONVERT W IN $\frac{Lb}{HR}$ TO $\frac{Kg}{HR}$ MULTIPLY BY 0.4536

TO CONVERT $\frac{U}{\Delta P}$ IN $\frac{BTU}{(HR)(LB)(°F)}$ TO $\frac{WATTS}{(M^2)(°K)(Pa)}$, MULTIPLY BY 0.1186

TO CONVERT $\frac{LB}{HR}$ TO $\frac{Kg}{HR}$, MULTIPLY BY 0.4536

ANGULAR ROD BAFFLE

BACKGROUND OF THE INVENTION

The invention relates to a baffle, a method for producing a baffle and a method and apparatus for supporting a plurality of tubes. In another aspect the invention relates to heat exchangers such as shell and tube heat exchangers and to a method and apparatus to radially support the tubes in such heat exchangers.

Heat transfer is an important part of any process. As is well known, an indirect transfer of heat from one medium to another is usually accomplished by the use of heat exchangers of which there are many types. For example, there are double pipe, shell and tube, plate heat exchangers and others. Indeed, the art of heat exchanger design is developed to a very high degree; however, there is still room for improvement in a number of areas, such as reducing pressure drop, increasing overall heat transfer coefficients, reducing fouling, and in heat exchangers utilizing a tube bundle, such as the shell and tube heat exchangers, improving tube support. In many instances the tubes in a shell and tube heat exchanger prematurely fail because the tubes vibrate or rub against one another or other parts of the heat exchanger, such as for example, a baffle or the shell.

The art has heretofore recognized the need for tube support.

Plate type baffles have been used in heat exchangers for many years. Such baffles provide support for the tubes at least to some degree. The double segmental plate-baffle heat exchanger is well known to those skilled in the art, and although heat exchangers using plate type baffles were a relatively early development in heat exchanger design, such exchangers are still widely used today. In most plate type baffle heat exchangers the passages in the plate baffles through which the tubes pass are slightly larger in diameter than the outside diameter of the tubes in order to facilitate construction of the exchanger, and as a result vibration of the tubes can and does occur which frequently results in premature tube failure.

U.S. Pat. No. 2,018,037, issued to Everett Norman Sieder on Oct. 22, 1935, describes a heat exchanger having a supported tube bundle in which a plurality of bars or rods is disposed in the lanes between tube rows. A bar or rod is disposed in each lane and affixed to a ring surrounding the tube bundle so that the bars form a series of parallel chords positioned in a plane perpendicular to the longitudinal axis of the tube bundle. When viewing a cross section of the longitudinal axis of the bundle as shown in FIGS. 2, 3 and 6 of the patent, a bar is shown in each and every lane. Thus, two groups or pluralities of bars provide radial support for each tube in the tube bundle. Although such a structure provides very good support for the tubes in the tube bundle, it incurs the penalty of a relatively large pressure loss which, besides being wasteful of energy, is usually a higher pressure loss than can be tolerated. In fact, even though this patented design is some 30 years old, it is not well accepted by industry as evidenced by the fact that it is rarely if ever used.

A tube support which is used and which does provide a low pressure drop is that described in U.S. Pat. No. 3,708,142, issued Jan. 2, 1973 to instant inventor. The design of the present invention provides a significant improvement in heat transfer coefficients with increasing flow rates and at the same time a measurable reduction in pressure drop as compared to the invention of U.S. Pat. No. 3,708,142, referred to above. In addition, tube bundles supported in accordance with the present invention are generally cheaper to fabricate as compared to those of the earlier invention.

It is emphasized that the present invention is a very significant breakthrough in heat exchanger design because supporting a tube bundle in accordance with the present invention limits tube failure due to each things as vibration, and when both the overall heat transfer coefficient and the pressure drop are considered, heat exchangers in accordance with the present invention provide better overall performance as compared to heat exchangers known in the art and particularly plate type baffle heat exchangers. Also, heat exchangers employing the inventive baffles and supporting apparatus are economically competitive with heat exchangers of the prior art.

An object of the invention is to support tubes of a tube bundle.

Another object of the invention is to lower the pressure drop on the shell side of the shell and tube heat exchanger.

Another object of the invention is to protect the tubes in a tube bundle from failure due to vibration.

Another object of the invention is to reduce the external fouling of tube bundles such as the fouling on the shell side of a shell and tube heat exchanger and the consequent loss of heat transfer capability.

Still another object of the invention is to provide a tube support to substantially reduce tube failure in a tube bundle and at the same time improve the ratio of the heat transfer coefficient to the pressure drop on the shell side of a shell and tube heat exchanger as compared to heat exchangers known in the art.

Other objects, aspects and advantages of the invention will be apparent to those skilled in the art upon a study of the specification and drawings.

SUMMARY OF THE INVENTION

According to the invention a baffle comprises an outer ring suitable for surrounding a plurality of parallel tubes formed into a tube bundle, the tube bundle having at least a first plurality of parallel tube rows, a second plurality of parallel tube rows and spaces between at least a portion of the adjacent tube rows, the outer ring being positioned in a plane which is not perpendicular to the longitudinal axis of the tube bundle, said plane forming a baffle angle with a plane which is perpendicular to the longitudinal axis of the tube bundle, and a plurality of parallel rods cooperating with and attached to said outer ring to form a plurality of parallel chords with said outer ring wherein said rods are capable of passing in the spaces between the tubes forming adjacent parallel tube rows of one plurality of parallel tube rows.

Further according to the invention a baffle is formed by arranging tubes in the form of a tube bundle having at least a first plurality of parallel tube rows and a second plurality of parallel tube rows and having spaces between at least a portion of the adjacent tube rows, positioning an outer ring in a plane which is not perpendicular to the longitudinal axis of the tube bundle around said tube bundle, said plane forming a baffle angle with a plane which is perpendicular to the longitudinal axis of the tube bundle, and inserting a plurality of rods through all of the spaces between adjacent parallel tube rows of one plurality of parallel tube rows to cooperate with the outer ring to form a plurality of parallel chords wherein each such rod is of sufficient size to provide support for the tubes in the tube rows adjacent said rod.

Further according to the invention a supporting apparatus for a plurality of tubes in the form of a tube bundle, wherein the tubes are positioned to form at least a first plurality of parallel tube rows, a second plurality of parallel tube rows, and spaces between at least a portion of the adjacent tube rows, comprises at least one baffle set providing radial support for each tube wherein each baffle set comprises two baffles and each baffle is as described above.

Further according to the invention a plurality of tubes is supported by arranging the tubes in the form of a tube bundle having at least a first plurality of parallel tube rows and a second plurality of parallel tube rows and having spaces between at least a portion of the adjacent tube rows, forming at least one baffle set to radially support each tube in the tube bundle comprising two baffles wherein each of said baffles is formed as above described.

DETAILED DESCRIPTION OF THE PREFERRED EMBODIMENTS

Figure 1:
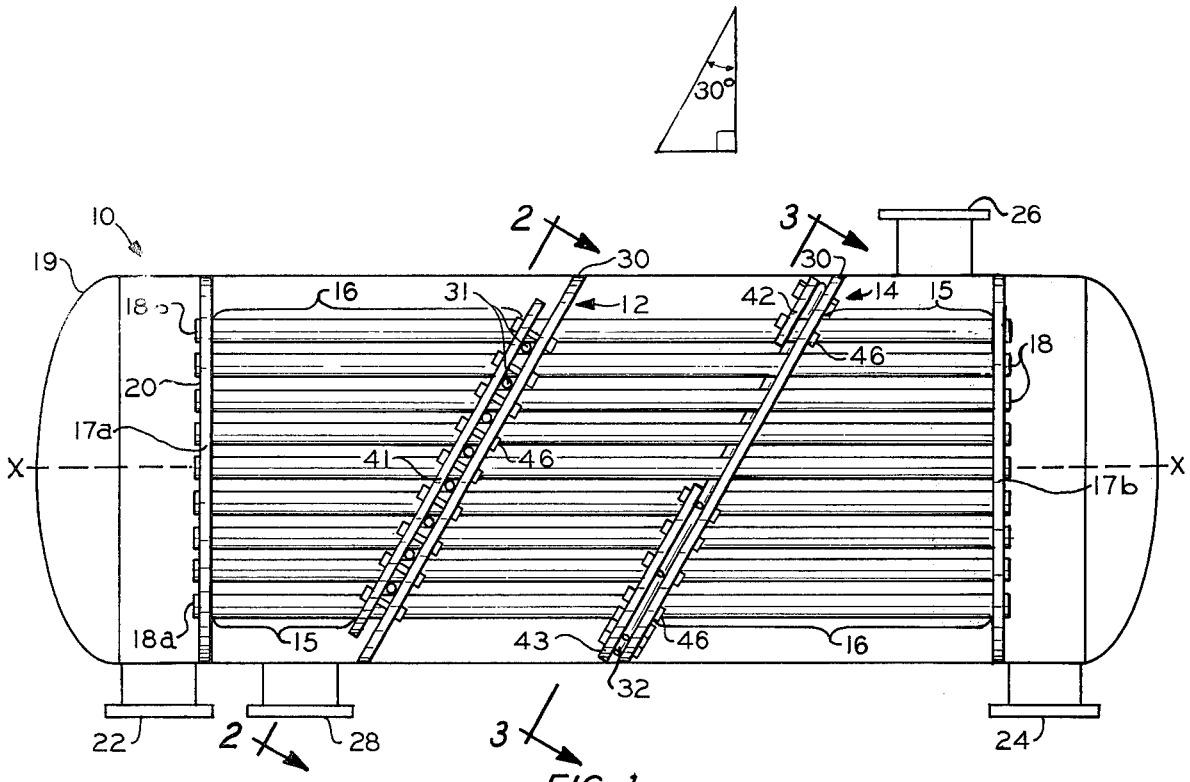
FIG. 1 is an elevational view of a heat exchanger employing an embodiment of the invention.

Heat exchangers are normally designed for relatively high flow rates of the fluids passed through them in order to obtain good heat transfer. Such high flow rates, particularly on the shell side of a shell and tube heat exchanger, frequently cause vibration of the tubes in the tube bundle if the tubes are not radially supported. Vibration of the tubes can and very often does cause one or more of the tubes to fail prematurely, that is, before the tube or tubes would be expected to fail based upon the materials used to construct the tubes and the service of the exchanger. Two of the common methods for reducing such vibration are the addition of plate baffles to add additional support to the tubes of the tube bundle and/or the lowering of the velocity of the fluid across the tubes. The addition of plate baffles causes a substantial increase in pressure drop through the shell side of the heat exchanger and a reduction in the shell side flow rate and the associated reduction in heat transfer rates requires a larger, more expensive exchanger than is otherwise necessary. The present invention solves the vibration problem without substantially increasing the shell side pressure drop or substantially reducing the shell side flow rate. As used herein the terms "pressure drop" and "pressure loss" are synonymous. It is noted that the heat exchanger and tube bundle designs shown in the drawings are schematic in nature and for purposes of better illustrating the invention. They are not intended as drawings showing the actual relative size of the exchanger and the component parts of the tube bundle.

Since one of the more important aspects of the invention is the reduction of tube failure due to vibration, the maximum unsupported tube distance is very important in designing a supporting apparatus. It is very important to prevent tube collisions by adjacent tubes between support points and to prevent tube failure due to vibration fatigue; thus the supporting apparatus is generally designed so that the maximum allowable tube deflection under load is equal to something less than one-half the clearance between adjacent tubes and the bending stress under conditions of vibration is within acceptable fatigue limits for the tube material used. Determination of acceptable fatigue limits for the tube material used is well known to those skilled in the art.

Figure 4:
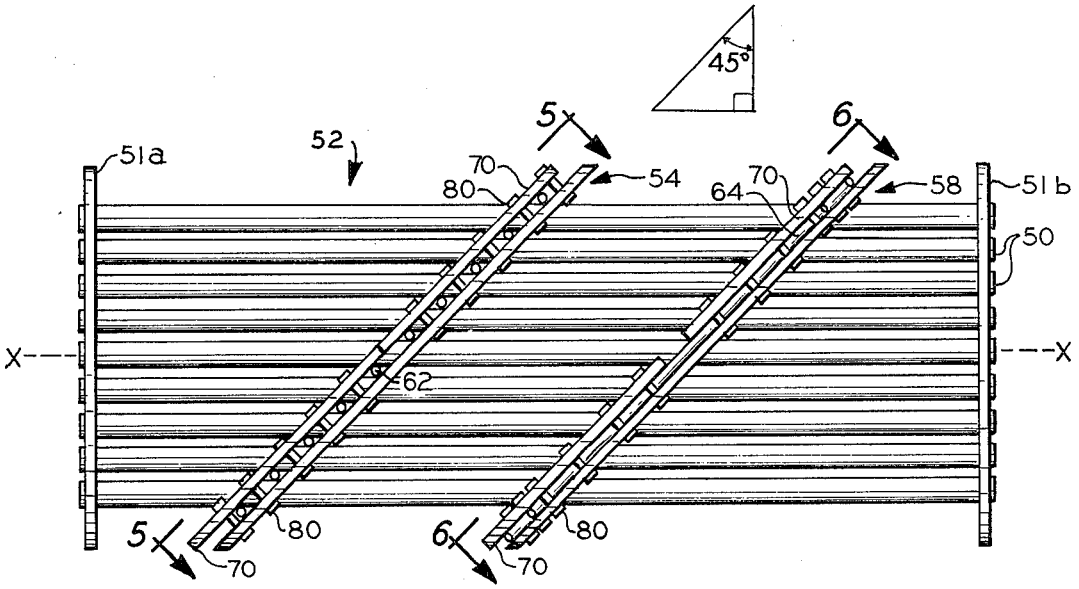
FIG. 4 is an elevational view of a plurality of tubes in the form of a tube bundle employing another embodiment of the invention.

Referring to FIG. 1, a heat exchanger, denoted generally by reference numeral 10, employing an embodiment of the invention has two tube sheets **17*a* and 17*b* and two baffles 12 and 14 supporting the tubes 18 which are in the form of a tube bundle 20 positioned inside shell 19. Each of baffles 12 and 14 is shown lying in a plane which is not perpendicular to the longitudinal axis, designated by "X", of tube bundle 20 which is an essential requirement to practice the present invention. The angle formed between the plane in which the baffle lies and a plane positioned perpendicular to the longitudinal axis of the tube bundle will hereinafter be referred to and is thus defined as the baffle angle. The baffle angles used in the embodiments of the invention shown in FIGS. 1 and 4 are 30° and 45°, respectively, as shown by the geometric inserts. As the baffle angle becomes larger, the tube support distance for a portion of the tubes becomes one of the limiting factors to be considered in the design of the exchanger. For example, as shown in FIG. 1, the support distance 15 for tube 18*a* measured from tube sheet 17*a* to baffle 12 is substantially smaller than distance 16 for tube 18*b* also measured from tube sheet 17*a* to baffle 12. As the baffle angle increases by rotating baffle 12 toward tube sheet 17*b* and maintaining distance 15 constant, distance 16 would be increased until it was equal to the length of tube 18*b*. The baffles of the present invention are in the geometric shape of an ellipse and the major axis of elliptical baffle 12 increases as the baffle is rotated as described above in order to reach across the tube bundle. In order to optimize the design of a particular heat exchanger of the invention, it may be desirable to use a partial baffle adjacent each tube sheet positioned to substantially reduce tube support distance 16**. The baffle angle must always be large enough to substantially reduce the shell side pressure drop of a heat exchanger employing said baffles as compared to a heat exchanger having the same type of baffles differing only in that the baffles of this latter heat exchanger are positioned in a plane lying perpendicular to the longitudinal axis of the tube bundle. Stated in another way, practice of the present invention requires a baffle angle which provides a substantial reduction in the shell side pressure drop as compared to an exchanger employing rod type baffles and having a baffle angle of zero degrees.

The pressure drop across the shell side of a heat exchanger having a given number of rod baffles in accordance with the present invention is minimized by positioning the baffles in such a manner that restriction of the horizontal free flow area of the shell at any given point along the length of the shell is minimized. In order to minimize the pressure drop of the shell side of a heat exchanger constructed in accordance with the present invention or, in other words, in order to minimize the restriction of the horizontal free flow area, the baffle angle and the baffle spacing should satisfy the following equations:

$$\text{Baffle angle} \geqq \tan^{-1} \frac{\text{rod O. D.}}{\text{tube O. D.} + \text{rod O. D.}} = \text{minimum baffle angle} \quad (1)$$

and, (2) Baffle spacing $\leqq$ shell I. D. $\times$ tan baffle angle wherein O. D. and I. D. indicate outside diameter and inside diameter, respectively. However, it is emphasized that the baffle spacing as calculated by equation (2) above may have to be reduced if the tube support distance required to prevent vibration fatigue is less than the baffle spacing required to minimize pressure drop as determined by equation (2) above. The prevention of vibration fatigue is normally the overriding consideration. In certain instances minimizing pressure drop may be the paramount consideration, and in such a situation the above equations should be satisfied regardless of the baffle spacing dictated by vibration fatigue calculations; however, such instances are expected to be the exception rather than the rule. The maximum baffle angle is generally governed by consideration of the maximum allowable tube support distance and the desired baffle spacing. In most applications the baffle angle will range from about 15° to about 80°; however, where the outside diameter of the rods is approximately equal to at least half the outside diameter of the tubes, the baffle angle more generally ranges from about 20° to about 65°. It is anticipated that baffle angles of 30°, 45° and 60° will be commonly used since these angles are easy to work with in constructing heat exchangers in accordance with the invention and these angles will generally satisfy the design criteria noted above for minimizing pressure drop across the shell side of the heat exchanger and providing for the proper baffle spacing. It is also expected that the baffle angles of 30° and 45° will be the most common since the smaller baffle angles permit the use of smaller tube support distances.

Figure 2:
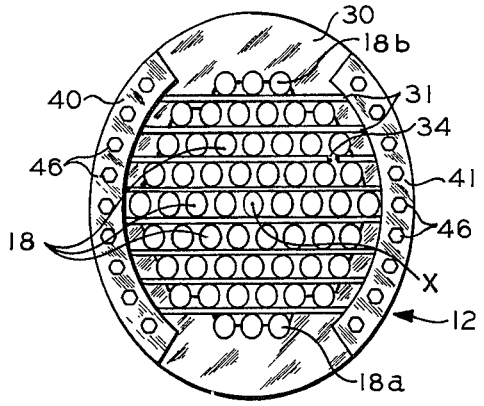
FIG. 2 is a cross-sectional view taken substantially on line 2—2 of FIG. 1 showing a baffle in accordance with the invention.
Figure 3:
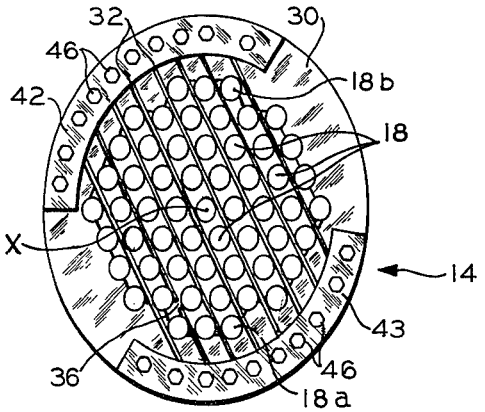
FIG. 3 is a cross-sectional view taken substantially on line 3—3 of FIG. 1 showing another baffle of the invention suitable for use in combination with that of FIG. 2.

In FIG. 1 the tube side of heat exchanger 10 has an inlet nozzle 22 and an outlet nozzle 24 to permit a first fluid to pass over the inside surface of the tubes and the shell side has an inlet nozzle 26 and an outlet nozzle 28 to permit a second fluid to pass over the outside surface of the tubes when using countercurrent flow of the heat exchange mediums. The tubes 18 in heat exchanger 10 are laid out on an equilateral triangular pitch as shown clearly in the baffles of FIGS. 2 and 3 and form at least a first and a second plurality of parallel tube rows oriented at 60° to one another. Baffle 12 of FIG. 2 shows the first plurality of parallel tube rows which are positioned parallel to rods 31. Adjacent parallel tube rows form spaces through which the rods are positioned. An example of such a space formed by two adjacent tube rows through which a rod is passed is indicated by reference numeral 34. Baffle 14 of FIG. 3 shows the second plurality of parallel tube rows which are positioned parallel to rods 32. An example of a space formed by two adjacent tube rows through which a rod is passed is indicated by reference numeral 36. Baffles 12 and 14 constitute a baffle set because both are required before all the tubes in the tube bundle are radially supported. As used herein a tube is "radially supported" when the tube is restricted from movement in all directions perpendicular to the longitudinal axis of the tube.

Each baffle in FIGS. 2 and 3 is made from an outer ring 30 surrounding the tubes 18 in the tube bundle 20. Rods 31 are positioned within the spaces 34 between adjacent rows of FIG. 2 and rods 32 within spaces 36 between adjacent rows of FIG. 3 so as to cooperate with outer ring 30 to form a plurality of parallel chords with outer ring 30. Generally rods 31 and 32 are affixed to outer ring 30, such as by welding them to the ring or bolting them to the ring using tie down members 40, 41 for baffle 12 and 42, 43 for baffle 14 along with bolts 46. Rods 31 and 32 must be of sufficient size to provide support for tubes 18 in the tube rows adjacent each rod. In order to provide radial support for all the tubes in the tube bundle by each baffle set, the number of rods used in each baffle must be equal to the total number of rods which could be positioned in the spaces between the tube rows of each baffle of the baffle set.

At least one baffle set is required in accordance with the invention but generally more than one baffle set is used, including partial baffle sets, that is, any number of baffles can be used in accordance with the invention as long as at least two baffles are used to constitute at least one baffle set. Also, as noted hereinbefore, the use of partial baffles may be necessary in order to optimize the design of a particular heat exchanger.

Figure 5:
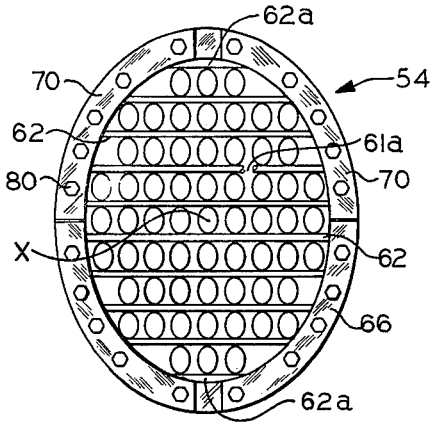
FIG. 5 is a cross-sectional view taken substantially on line 5—5 of FIG. 4 showing a baffle of the invention.
Figure 6:
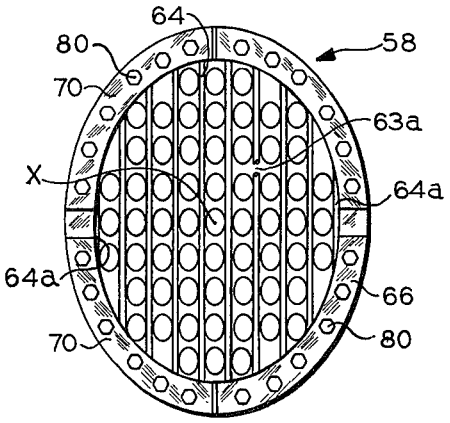
FIG. 6 is a cross-sectional view taken substantially on line 6—6 of FIG. 4 showing another baffle of the invention suitable for use with that of FIG. 5.

FIGS. 4 through 6 illustrate a preferred embodiment of the invention because the tubes 50 in tube bundle 52 having tube sheets **51*a* and 51*b* are laid out in square pitch and generally a square pitch tube layout provides greater surface area for a given shell diameter for an apparatus constructed in accordance with the invention. For example, there are 61 tubes in the embodiment of the invention shown in FIGS. 4 to 6 and only 57 tubes in the embodiment of the invention shown in FIGS. 1 to 3, and both embodiments are drawn to the same scale. The invention as illustrated in FIGS. 4 through 6 shows two baffles 54 and 58 which constitute a baffle set in accordance with the present invention. The baffle angle as shown in the insert is 45°. In FIGS. 5 and 6 there is a first plurality of parallel tube rows adjacent the horizontal rods 62 and there is a second plurality of parallel tube rows adjacent the vertical rods 64. Rods 62 and 62*a*** are positioned in the space between the horizontal tube rows and cooperate with outer ring 66 to form a plurality of parallel chords with outer ring 66. An example of a space between adjacent tube rows is represented in FIG. 5 by reference numeral 61*a* and in FIG. 6 by reference numeral 63*a*. Rods 64 and 64*a* are also positioned in the space between the vertical tube rows and cooperate with outer ring 66 to form a plurality of parallel chords with outer ring 66. Rods 62, 62*a*, 64 and 64*a* are of sufficient size to provide support for the tubes in the tube rows adjacent each rod. The rods in the baffles shown in FIGS. 4 to 6 are held in position by tie down members 70 bolted to rings 66 using bolts 80.

In the embodiment of the invention as shown in FIGS. 4 to 6 the baffles are shown in the presently preferred embodiment wherein rings 66 are simply an annular shape as compared to rings 30 of FIGS. 1 to 3 in which the inside edge of rings 30 is cut to provide partial support for the tubes located adjacent the inside edge of the rings; however, it is difficult to make the circular cuts for partially supporting the tubes located adjacent the inside edge of the rings 30 so that no radial movement of the tubes is allowed. The design of baffles 54 and 58 of FIGS. 4 to 6 avoids this problem simply by not making the ring with such cuts and using two additional rods to support the tubes which would be otherwise partially supported by the cut edges of the ring. The additional rods 62*a* are shown in FIG. 5 and additional rods 64*a* in FIG. 6. Further, the design of the baffles with annular rings 66 in FIGS. 4 to 6 is preferred because such a design further reduces the pressure loss through the heat exchanger since part of the ring which restricted the flow of the shell side fluid is eliminated. Therefore, this design simplifies the construction of the baffles and particularly rings 66, helps prevent premature tube failure due to the tubes rubbing against the relatively sharp inside edge of the rings, and further reduces the pressure loss across the shell side of the heat exchanger.

It is apparent from the above description of FIGS. 1 to 6 that the minimum number of baffles per baffle set is two and this number is not dependent upon the tube layout. Two different tube layouts are shown in the drawings; however, other tube layouts are possible. But with any tube layout, at least two baffles per baffle set are required to practice the present invention, and the specific tube layouts herein discussed are presented for the purposes of illustration and are not intended to limit the broad invention.

Figure 10:
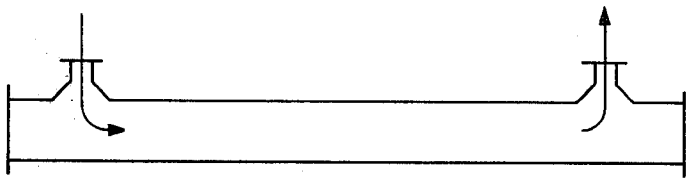
FIG. 10 is a schematic representation of a shell suitable for use in the invention having divergent inlet and outlet nozzles.
Figure 11:
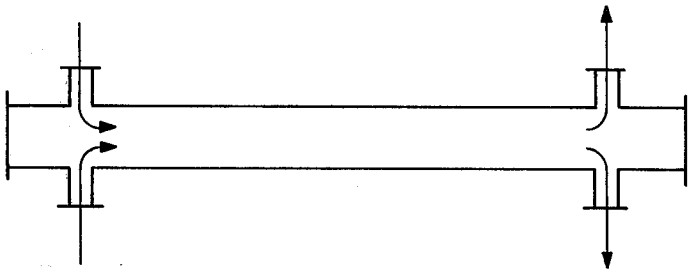
FIG. 11 is a schematic representation of a shell suitable for use in the invention having multiple inlet and outlet nozzles.

It is presently believed that the shell side pressure drop for any given exchanger designed in accordance with the invention will be largely localized at or near the inlet and outlet regions of the shell, and thus it is recommended to employ inlet and outlet shell side nozzle designs having low turbulence and pressure drop characteristics. For example, diverging nozzles as shown in FIG. 10, multiple nozzles as shown in FIG. 11 and annular distributors provide low pressure drop and low turbulence in the shell side inlet and outlet regions. It is important in designing an apparatus in accordance with the invention to note that the fluid on the shell side of the apparatus flows essentially in the longitudinal direction, that is, essentially parallel to the longitudinal axis of the tubes; therefore, it is recommended that longitudinal flow channels or passageways which are relatively large in relation to the clearance between the tubes be minimized either by actual elimination of such passageways or blocking off such passageway using suitable baffles.

Inherent in the design of an apparatus shown in FIGS. 1 to 6 is the incorporation of a ring baffle which restricts the flow of the shell side fluid between the shell and the tube bundle and also provides a foundation for the rods in order to form the rod baffle.

It is appreciated by those skilled in the art that heat exchangers designed in accordance with the invention can be designed incorporating a variety of the configurations shown in the art such as U-tubes, multiple tube passes, floating head designs, etc.

Although the baffles are normally arranged in the tube bundle so that they all have the same baffle angle and slant in the same direction as shown in FIGS. 1 and 4, it is within the scope of the invention, however, to employ two or more baffles having different baffle angles and/or slanting in any number of directions.

In an effort to more fully describe the invention the following example is provided.

EXAMPLE

Figure 7:
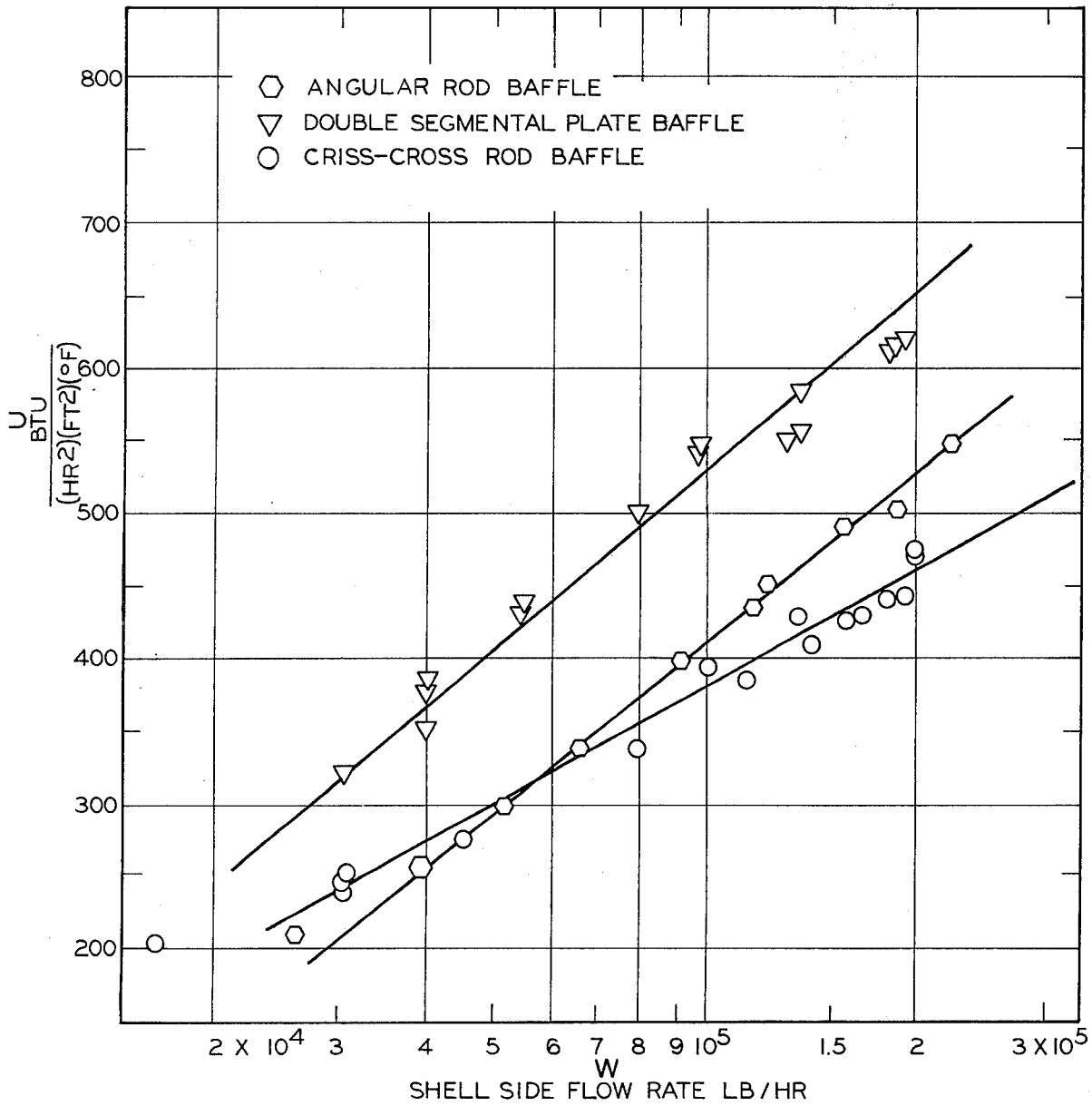
FIG. 7 graphically illustrates the overall heat transfer coefficient measured as a function of shell side flow rate for a heat exchanger made in accordance with applicant's invention and for two prior art heat exchangers.
Figure 8:
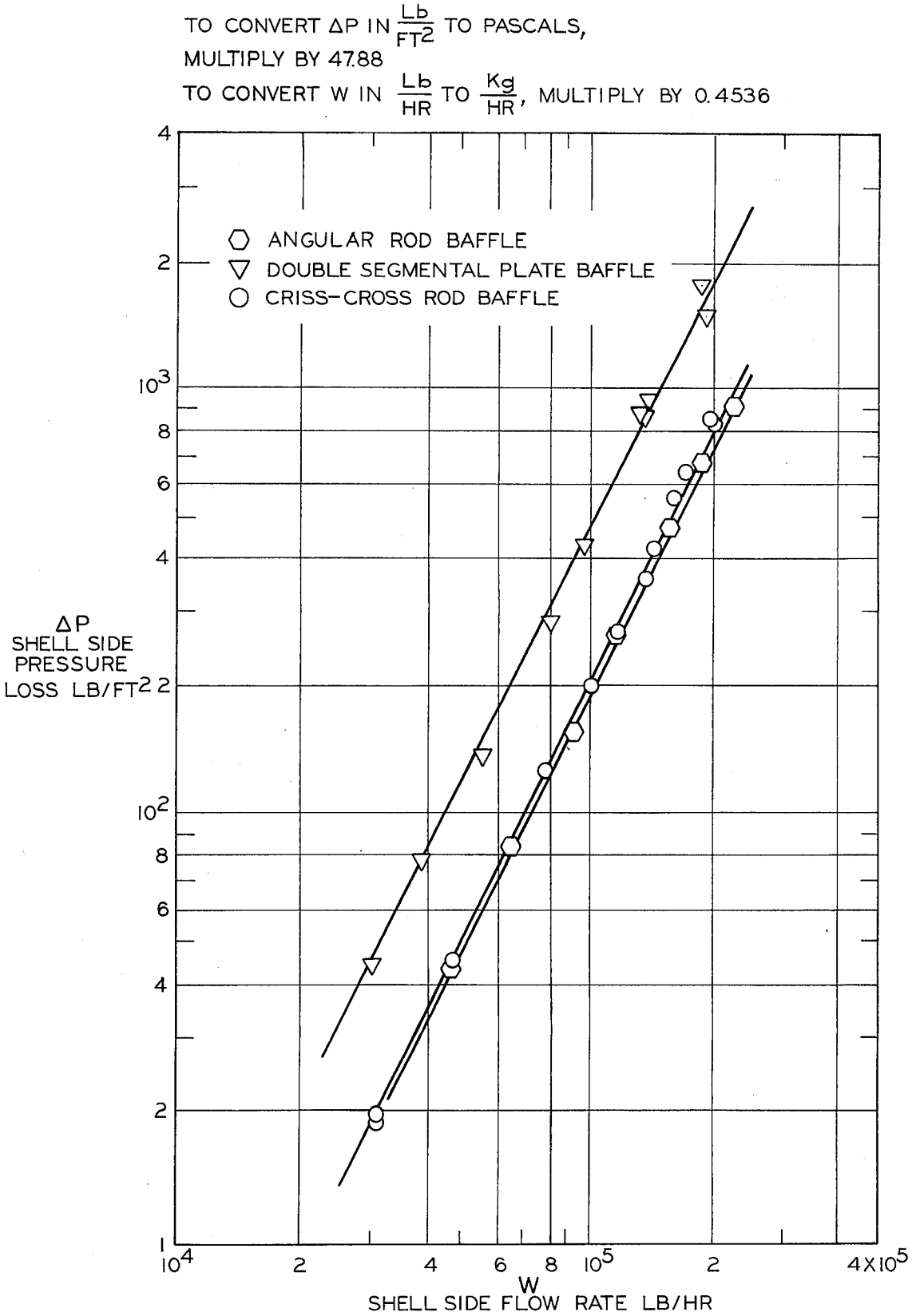
FIG. 8 is a graphical illustration of shell side pressure drop measured as a function of shell side flow rate employing the heat exchangers used for determining the values shown in the graph of FIG. 7.
Figure 9:
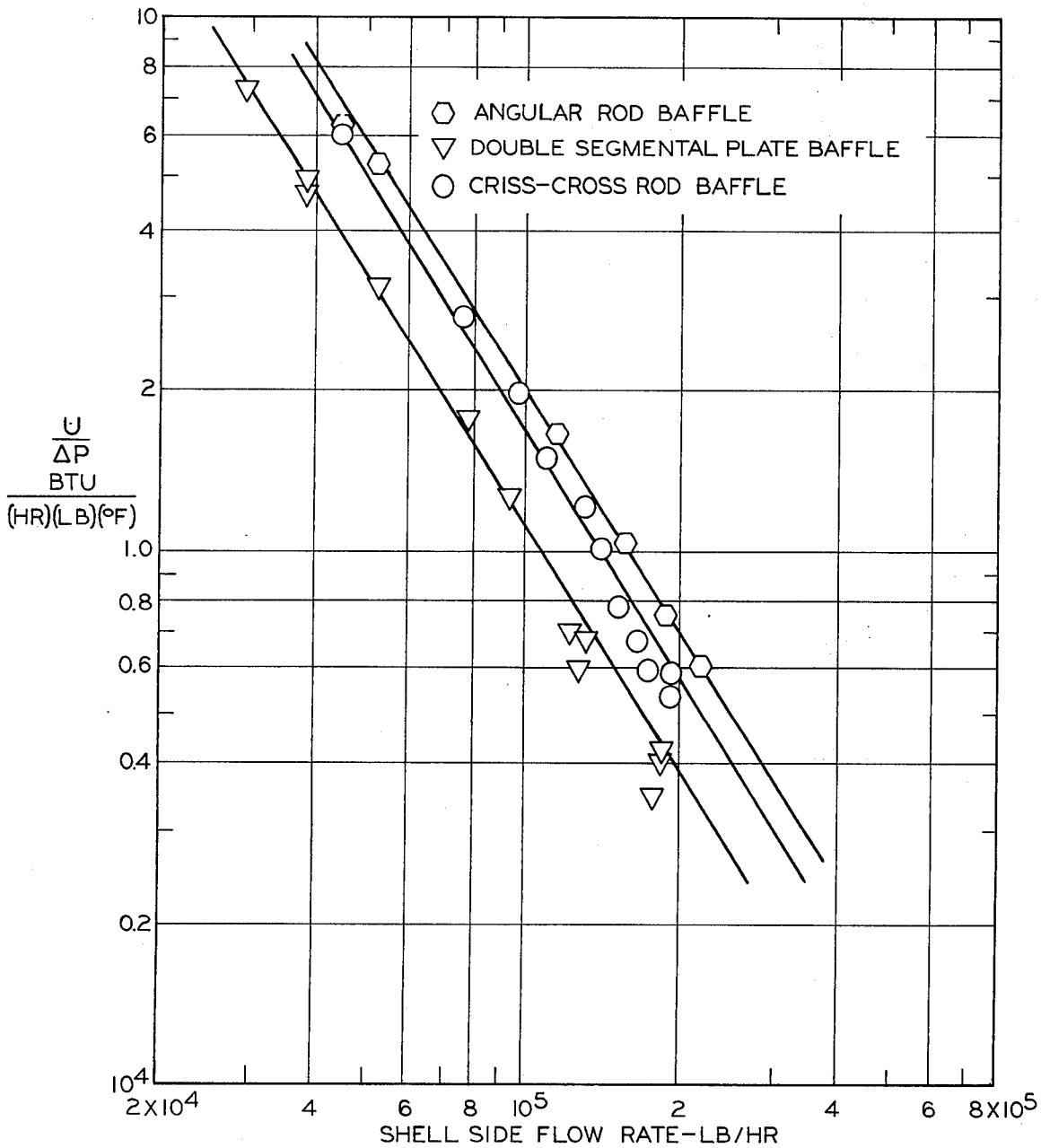
FIG. 9 illustrates graphically the ratio of the overall heat transfer coefficient to pressure drop measured as a function of shell side flow rate employing the same heat exchangers used for determining the values shown in the graphs of FIGS. 7 and 8.

Three countercurrent, single pass shell and tube heat exchangers were constructed and tested. Each heat exchanger contained 137 carbon steel tubes, 9.7 feet (2.96 m) long with a 0.5 inch (1.27 cm) outside diameter, laid out on a square pitch of 0.6875 inch (1.7463 cm) and having a shell inside diameter of 10.25 inches (26.04 cm). Each heat exchanger was designed to have the same minimum tube support distance, 9.8 inches (24.89 cm). Both the shell side fluid and the tube side fluid were water with the tube flow rate equal to 4.2 feet per second (1.28 m/sec.), 115,800 pounds per hour. Hot fluid (shell side) inlet temperatures were generally about 165° F. (73.9° C.) with the cold fluid (tube side) inlet temperatures employed being appropriate values between 80° F. (26.7° C.) and 130° F. (54.4° C.). Thereby the temperature approach at each end of a tested exchanger was maintained greater than 10° F. to provide adequate heat exchange driving force, as known to those skilled in this art, from which consistent test results were calculated. The shell side flow rate, W, was varied from about 2500 to 20,000 pounds per hour (1134 to 9072 Kg/hr). FIGS. 7, 8 and 9 graphically illustrate the results of the tests in which the overall heat transfer coefficient, U; pressure drop, $\Delta P$; and the ratio $U/\Delta P$ were determined as functions of the shell side flow rate, W, by appropriate methods of calculation known to those skilled in this art from data taken during comparable test runs. Conversion factors are on each of the drawings for converting the data from English Units to the International System of Units.

One heat exchanger design employed was the double segmental plate baffle type referred to hereinafter as the segmental plate baffle heat exchanger. The baffle cut was 50 percent, that is, the baffle cut was such that it would provide an open area equal to substantially 50 percent of the total cross-sectional area of the shell less the space occupied by the tubes. This type of exchanger is frequently used and considered one of the standard designs in the industry. The tube support distance was 9.8 inches (24.89 cm); thus the baffle spacing was 4.9 inches (12.45 cm).

The second heat exchanger design employed was that described in U.S. Pat. No. 3,708,142, hereinafter referred to as the crisscross rod baffle heat exchanger. In this design each baffle provides radial support for each tube in the tube bundle; thus for a tube support distance of 9.8 inches (24.89 cm) a baffle spacing of 9.8 inches (24.89 cm) was used.

The third heat exchanger design was that of the present invention, referred to hereinafter as the angular segmental rod baffle heat exchanger constructed in accordance with FIGS. 1 through 3 previously described. The baffle spacing of 4.9 inches was used to provide a tube support distance of 9.8 inches (24.89 cm), the same as used in the other two heat exchangers previously described. The baffle angle was 45° and the rods had an outside diameter of 0.1875 inch (0.4763 cm).

As shown in FIG. 7, the angular rod baffle heat exchanger provided an unexpected increase in the heat transfer coefficient over that of the crisscross rod baffle heat exchanger above a shell side flow rate of 58,000 lbs./hr. The double segmental plate baffle heat exchanger provided a higher heat transfer coefficient throughout the range of shell side flow rates tested.

FIG. 8 shows that the shell side pressure loss (in pounds per square foot) of the angular rod baffle heat exchanger was lower than that of the crisscross rod baffle heat exchanger and that the pressure drop for either of those two heat exchangers was substantially better than the pressure loss of the double segmental plate baffle heat exchanger.

FIG. 9 shows that the ratio of the heat exchanger coefficient to the pressure loss for a given shell side flow rate is higher for the angular rod baffle heat exchanger as compared to either of the prior art heat exchangers. This graph, combining the results of FIGS. 7 and 8, provides an overall picture of the results obtained employing the tube support method and apparatus of the present invention because both the pressure drop and the heat transfer coefficient are taken into consideration at the same time.

These three graphs and especially FIG. 9 clearly establish that the present invention definitely provides unexpected results as compared to prior art heat exchangers including one in which the baffles were constructed with rods.

What is claimed is:

1. Supporting apparatus for a plurality of tubes in the form of a tube bundle suitable for use in a shell and tube heat exchanger, said tubes positioned to form at least a first plurality of parallel tube rows and a second plurality of parallel tube rows and spaces between at least a portion of the adjacent tube rows comprising:

at least one baffle set providing radial support for each tube and comprising two baffles, wherein each baffle is positioned along the length of the tube bundle a distance relative to the other baffle of the baffle set and wherein each baffle comprises an outer ring surrounding said tube bundle positioned in a plane which is not perpendicular to the longitudinal axis of said tube bundle, said plane forming a baffle angle with a plane which is perpendicular to the longitudinal axis of the tube bundle; and a plurality of rods positioned in all of the spaces between adjacent tube rows in one plurality of parallel tube rows so that one rod is positioned in each space, said plurality of rods cooperating with said outer ring to form a plurality of parallel chords with said outer ring, and each said rod being of sufficient size to provide support for the tubes in the tube rows adjacent said rod.

2. The apparatus of claim 1 wherein the tubes are laid out on a square pitch.

3. The apparatus of claim 1 wherein the tubes are laid out on a triangular pitch.

4. The apparatus of claim 1 comprising a plurality of baffle sets.

5. The apparatus of claim 1 wherein the baffle angle ranges from about 15° to about 80°.

6. The apparatus of claim 1 wherein the baffle angle ranges from about 20° to about 65°.

7. The apparatus of claim 1 wherein the baffles are equally spaced along the tube bundle as measured along the longitudinal axis of the tube bundle.

8. The apparatus of claim 1 wherein the baffle angle is large enough to substantially reduce the shell side pressure drop as compared to the same baffle having a baffle angle of zero degrees.

9. The apparatus of claim 1 wherein the baffles are spaced along the longitudinal axis of the tube bundle so that the maximum allowable tube deflection under load is equal to less than one-half the clearance between adjacent tubes and the bending stress under conditions of vibration is within acceptable fatigue limits for the tube material used.

10. The apparatus of claim 1 wherein the baffle angle is $$\geqq \tan^{-1} \frac{\text{rod O. D.}}{\text{tube O. D.} + \text{rod O. D.}}.$$

11. Apparatus comprising:

a plurality of tubes forming a tube bundle suitable for use in a shell and tube heat exchanger, said tubes positioned to form at least a first plurality of parallel tube rows and a second plurality of parallel tube rows and spaces between at least a portion of the adjacent tube rows;

means supporting the ends of said tube bundle; and intermediate means supporting the tubes in the tube bundle intermediate their ends, said intermediate supporting means comprising at least one baffle set, each baffle set providing radial support for each tube and comprising two baffles wherein each baffle is positioned along the length of the tube bundle a distance relative to the other baffle of the baffle set and wherein each baffle comprises an outer ring surrounding said tube bundle and positioned in a plane which is not perpendicular to the longitudinal axis of said tube bundle, said plane forming a baffle angle with a plane which is perpendicular to the longitudinal axis of the tube bundle; and a plurality of rods positioned in all of the spaces between adjacent tube rows in one plurality of parallel tube rows so that one rod is positioned in each space, said plurality of rods being attached to said outer ring and forming a series of parallel chords with said outer ring, said rods being of sufficient size to provide support for the tubes in the tube rows adjacent each rod.

12. The apparatus of claim 11 further comprising a shell surrounding said tube bundle isolating the outside surface of the tubes from the inside surface of the tubes, said shell having an inlet and an outlet for a first fluid to pass over the inside surface of the tubes and an inlet and an outlet for a second fluid to pass over the outside surface of the tubes.

13. The apparatus of claim 12 wherein the inlet and outlet for the second fluid to pass over the outside surface of the tubes are nozzles of a design which minimizes the pressure drop and turbulence at or near these regions of the apparatus.

14. The apparatus of claim 11 wherein the baffle angle ranges from about 15° to about 80°.

15. The apparatus of claim 11 wherein the baffle angle ranges from about 20° to about 65°.

16. The apparatus of claim 15 wherein the baffle angles of the baffles are different.

17. The apparatus of claim 11 wherein the baffles are spaced along the longitudinal axis of the tube bundle so that the maximum allowable tube deflection under load is equal to less than one-half the clearance between adjacent tubes and the bending stress under conditions of vibration is within acceptable fatigue limits for the tube material used.

18. The apparatus of claim 11 wherein the baffle angle is $$\geqq \tan^{-1} \frac{\text{rod O. D.}}{\text{tube O. D.} + \text{rod O. D.}} .$$

19. Apparatus according to claim 7 wherein the planes in which each outer ring is positioned are parallel to one another.

20. Apparatus according to claim 11 wherein the planes in which each outer ring is positioned are parallel to one another and wherein the baffles are equally spaced along the tube bundle as measured along the longitudinal axis of the tube bundle.

* * * * *